US011185135B2

(12) United States Patent
Zanghi

(10) Patent No.: US 11,185,135 B2
(45) Date of Patent: Nov. 30, 2021

(54) BRACELET AND METHOD OF MANUFACTURING A BRACELET

(71) Applicant: Gatherband, LLC, Charlotte, NC (US)

(72) Inventor: Mark Zanghi, New York, NY (US)

(73) Assignee: Gatherband, LLC, Charlotte, NC (US)

( * ) Notice: Subject to any disclaimer, the term of this patent is extended or adjusted under 35 U.S.C. 154(b) by 0 days.

(21) Appl. No.: 16/851,183

(22) Filed: Apr. 17, 2020

(65) Prior Publication Data

US 2021/0321728 A1 Oct. 21, 2021

(51) Int. Cl.

| | |
|---|---|
| ***A44C 5/00*** | (2006.01) |
| ***A44C 27/00*** | (2006.01) |
| ***A44C 15/00*** | (2006.01) |

(52) U.S. Cl.

CPC ..... *A44C 5/0053* (2013.01); *A44C 15/004* (2013.01); *A44C 27/008* (2013.01)

(58) Field of Classification Search

CPC ... A44C 5/0053; A44C 15/004; A44C 27/008; A44C 5/0015; A44C 5/2071; A44C 5/14; A44C 5/0007; A44C 17/0208; A44C 17/0216

See application file for complete search history.

(56) References Cited

U.S. PATENT DOCUMENTS

| | | | | |
|---|---|---|---|---|
| 8,474,284 | B2 * | 7/2013 | Rush | A44C 5/003 63/40 |
| D823,710 | S * | 7/2018 | Schone | D11/86 |
| 2007/0194066 | A1 * | 8/2007 | Ishihara | G04B 37/1486 224/164 |
| 2011/0277501 | A1 * | 11/2011 | Davis | A44C 5/0015 63/1.13 |
| 2014/0090418 | A1 * | 4/2014 | Mihalyo | A44C 5/0007 63/3 |
| 2015/0359304 | A1 * | 12/2015 | Thomas | A44C 5/0007 63/1.11 |
| 2016/0353846 | A1 * | 12/2016 | Zanghi | A44C 5/0053 |
| 2017/0224070 | A1 * | 8/2017 | Simones | A44C 5/0053 |

FOREIGN PATENT DOCUMENTS

| | | | | |
|---|---|---|---|---|
| CH | 1552867 | A4 * | 2/1972 | A44C 5/14 |
| DE | 1787013 | A1 * | 1/1974 | A44C 5/14 |
| WO | WO-2013091046 | A1 * | 6/2013 | G09F 21/026 |

* cited by examiner

*Primary Examiner* — Jack W Lavinder
(74) *Attorney, Agent, or Firm* — Bond Schoeneck & King, PLLC; George McGuire

(57) ABSTRACT

A bracelet defined by an elongated band having first and second terminal end sections that collectively define a clasp and a plurality of interconnected sockets extending along the length of the band and in each of which a rigid shell is positioned. A pair of charms each having unique indicia, such as a letter, imprinted thereon can be removably and interchangeably positioned within each shell. As an example of use, multiple friends' initials can therefore be displayed with charms positioned within each or many of the plurality of sockets forming bracelet.

8 Claims, 8 Drawing Sheets

BRACELET AND METHOD OF MANUFACTURING A BRACELET

BACKGROUND

The present invention relates generally to bracelets, and more particularly to bracelets in which charms can be removably attached.

Charm bracelets are well known types of jewelry in which charms having various representations expressed thereon are attached to a bracelet. Most typically, the bracelet is a metal dangle that includes small rings or other connectors to which the charms can be removably attached. A plethora of charms having different symbolism or meaning to the wearer can be displayed on the bracelet.

In more recent times rubber or silicone bracelets have become popular. Such bracelets are often used as charity fundraisers and come in a color representative of the charity's cause, such as pink for breast cancer awareness. Adaptations of these rubber/silicone bracelets are charm bracelets that include charms that can be attached to the bracelet.

Another popular trend with bracelets is what is referred to as "friendship bracelets". These are bracelets exchanged between friends that symbolize the friendship. The bracelets may have matching charms or other items that represent the friendship.

In Applicant's prior patent application Ser. No. 15/173,898, a friendship charm bracelet was disclosed. In that bracelet, however, the elements comprising the bracelet were not engineered to a degree that provided a reliable and long-lasting bracelet.

What would be useful is a flexible charm bracelet in which many permutations of meaningful combinations of charms can be matched and displayed in a manner that has been engineered to be structurally sound and provide longevity for its use.

Accordingly, there is a need in the art for a charm bracelet that facilitates social activity and sharing in a structurally sound product.

Accordingly, there is a need in the art for a bracelet that permits interchangeability of design elements in a structurally sound product.

SUMMARY OF THE INVENTION

The present disclosure is directed to a ready to a bracelet.

According to an aspect a bracelet is provided, comprising a molded band of predetermined length extending between first and second terminal ends, having upper and lower surfaces, and being composed of a flexible material, the band comprising a plurality of openings formed therethrough and with a V-shaped notch formed in the lower surface between each successive opening; a shell composed of a rigid material lining each of the plurality of openings formed through the band, each shell comprising a pair of opposed long interior surfaces and a pair of opposed short interior surfaces that defined a predetermined width between the opposing interior long surfaces and a predetermined length extending between the predetermined short surfaces, and a protrusion formed on each of the opposed long interior surfaces; and a plurality of charms each of which contains indicia imprinted thereon, each charm being of a width that is the same as the predetermined width and a length that is one half the predetermined length, each charm comprising a recess formed in opposing side surfaces thereof that correspond in size and shape the protrusions formed on the interior long surfaces of the shells.

According to an embodiment, the band comprises a plurality of tread-like ridges formed around the periphery of each opening.

According to an embodiment, each shell engages the plurality of tread-like ridges, whereby the interconnection between the shell and band is reinforced.

According to an aspect a method of manufacturing a bracelet is provided, comprising the steps of molding an elongated band that extends a predetermined length between first and second terminal ends with a plurality of openings formed in succession therethrough; forming a V-shaped notch between each successive opening; over molding a rigid shell within each opening, with each shell comprising opposing long interior surfaces and opposing short interior edges; and forming a protrusion on each long interior surface.

According to an embodiment, the method further comprises the step of forming tread-like ridges around the periphery of each opening.

According to an embodiment, the method further comprises the step of forming a plurality of charms each of which includes a pair of opposing long surfaces and a pair of opposing short edges.

According to an embodiment, the method further comprises the step of forming a recess in each opposing short edge of each charm that corresponds in size and shape with the protrusions formed on each long interior surface of each shell.

According to an embodiment, the method comprises the further step of screen-printing indicia on the upper surface of each charm to maintain the planarity of the upper surface.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1B:
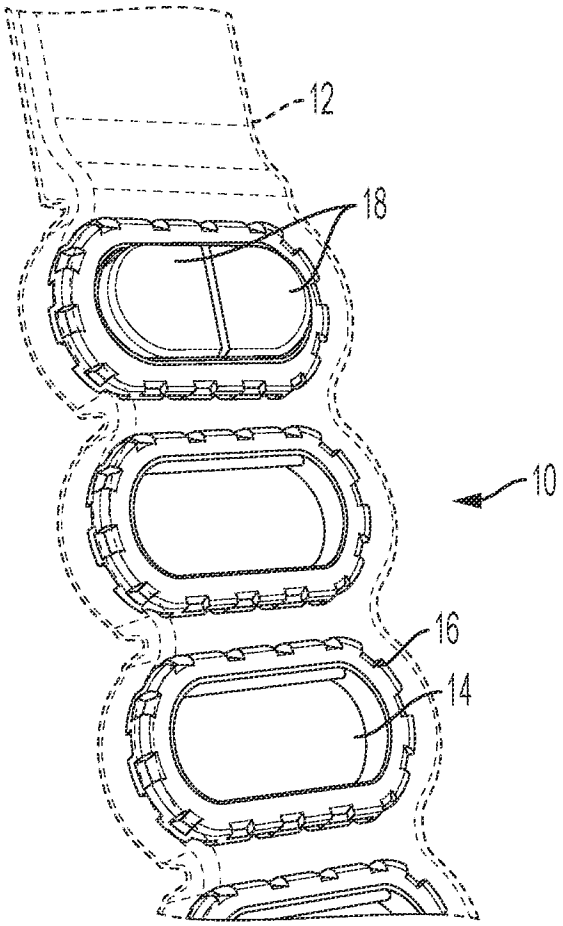
FIGS. 1A and 1B are partial perspective views of a bracelet at two stages of a manufacturing process, respectively, in accordance with an embodiment.
Figure 1A:
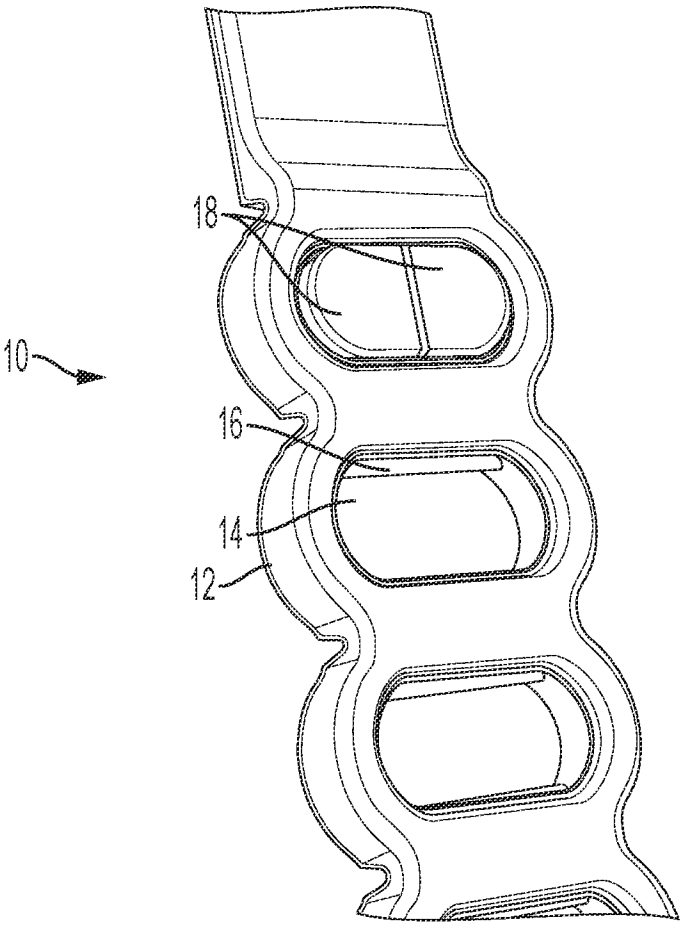
Figure 2B:
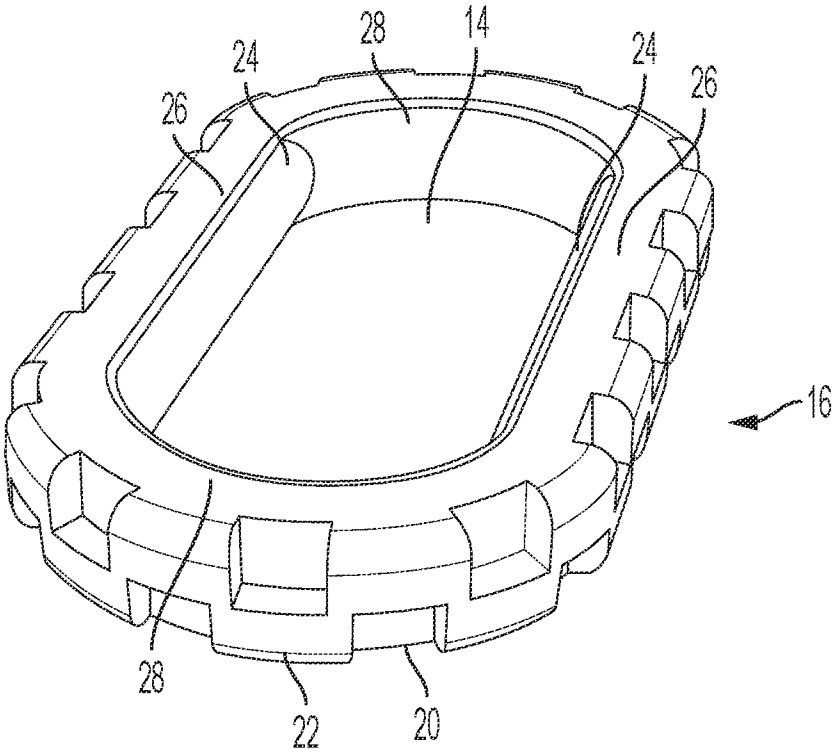
FIGS. 2A and 2B are perspective views of the shell portion of the bracelet with and without charms, respectively, in accordance with an embodiment.
Figure 2A:
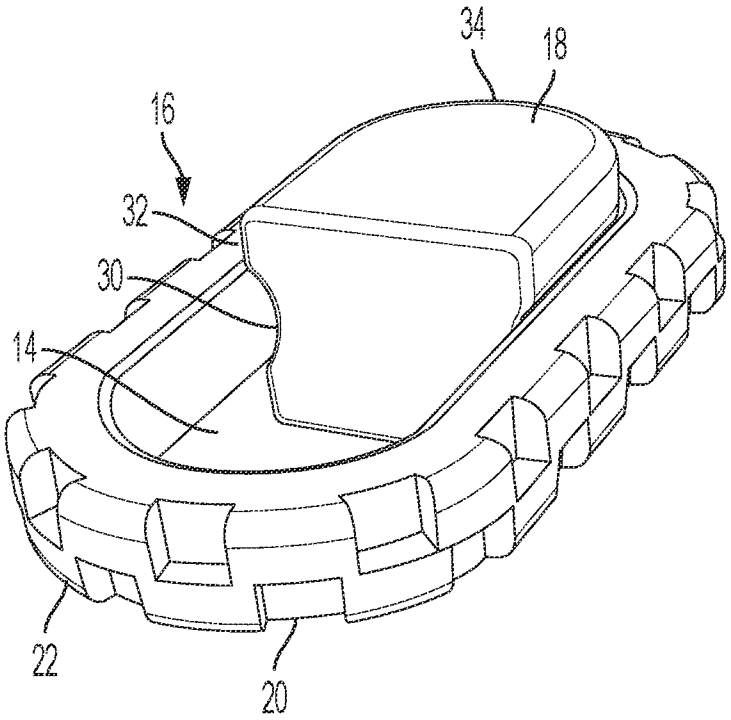

The present disclosure describes a bracelet 10.

Bracelet 10 comprises an elongated band 12 having a plurality of sockets 14 extending in succession along the length thereof, a plurality of shells 16 positioned within the sockets 14 (one shell per socket), and a plurality of charms 18, wherein a pair of charms 18 are removably and interchangeably positioned within each shell 16.

Each socket 14 is defined as a through hole in which a rigid shell 16 is positioned in liming relation and which permit charms 18 to be inserted from either the backside or frontside with equal simplicity. In forming the sockets 14 as through holes, the method of manufacture comprises the steps of placing a rigid shell 16 within the socket and over molding it, as shown in FIG. 1B. This process creates a rigid spine lining the periphery of each socket 14 enhancing the rigidity and durability of the band 12 while maintaining complete flexibility in the band 12. Each socket 14 further comprises tread like ridges 20 formed around the periphery thereof while each shell includes corresponding treads 22 formed around the exterior thereof to increase friction and adhesion to the silicone during the over molding process to permanently embed the shells 16 within the sockets 14 of band 12.

Each shell 16 further includes an extrusion 24 protruding from the interior surface of each long edge 26 thereof; the short edges 28 are left smooth without any protrusion. The charms 18 are likewise formed with a recess 30 extending along their long edges 32 that correspond in size and shape with the protruding extrusion 24 formed in the shells 16, thereby permitting the charms 18 to be easily snapped into and out of the shells 16. Moreover, by leaving the shells' shorter edges 28 free of the protrusions, and likewise the charms shorter edges 34 being free from recesses, it minimizes the amount of force needed to move the charms into and out of the shells 16. Also, due to the rigidity provided by shells 16, this minimal amount of securement between the charms 18 and shells 16 is more than enough to secure the interconnection unless and until manually and intentionally altered. It should be noted that the length of long edges 32 of charms 18 are about half the length of the length of long edges 26 of shells 16, and the length of the short edges 34 of charms 18 are equal in length to that of the short edges 28 of shells 16 to facilitate a secure fit of a pair of charms 18 in each shell 16.

Figure 3:
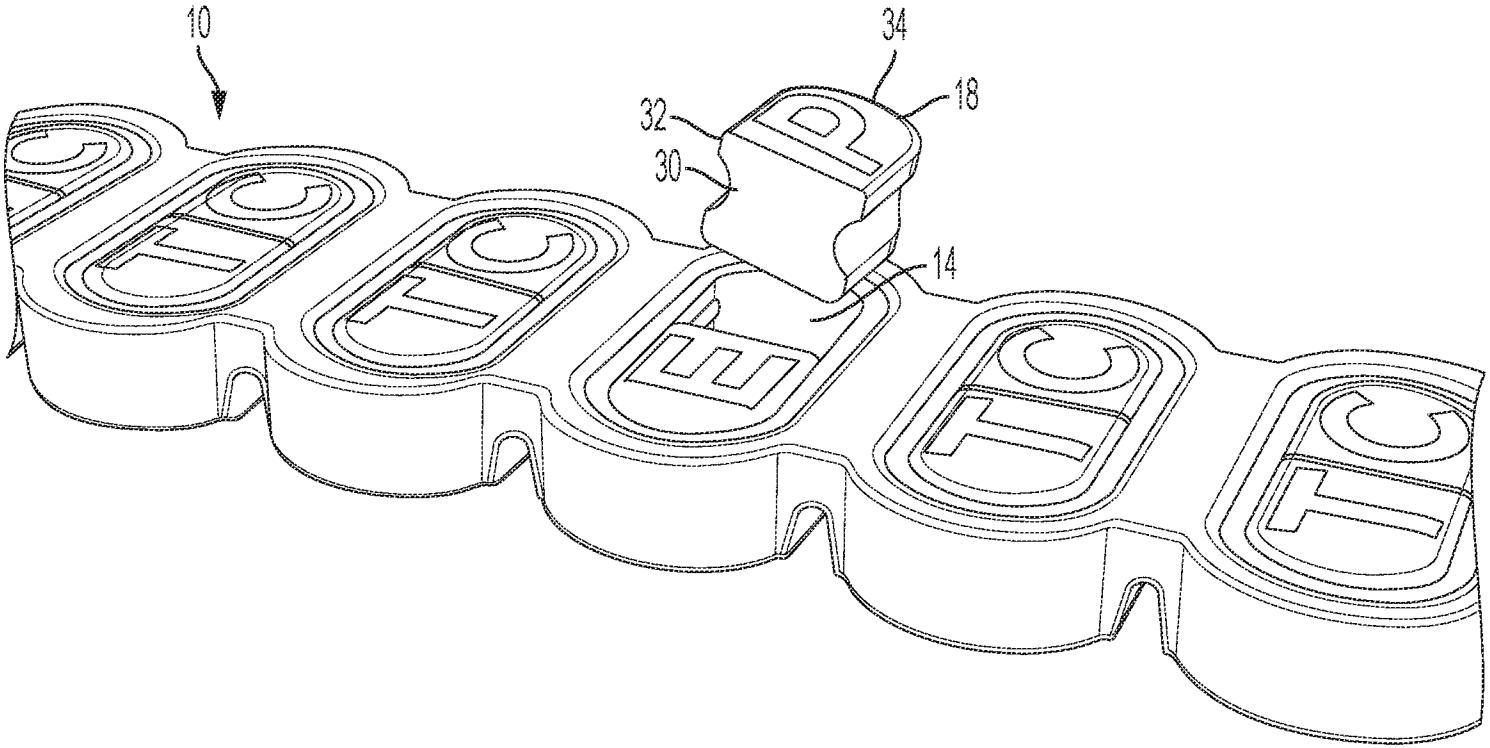
FIG. 3 is a perspective view of the bracelet, in accordance with an embodiment.
Figure 4:
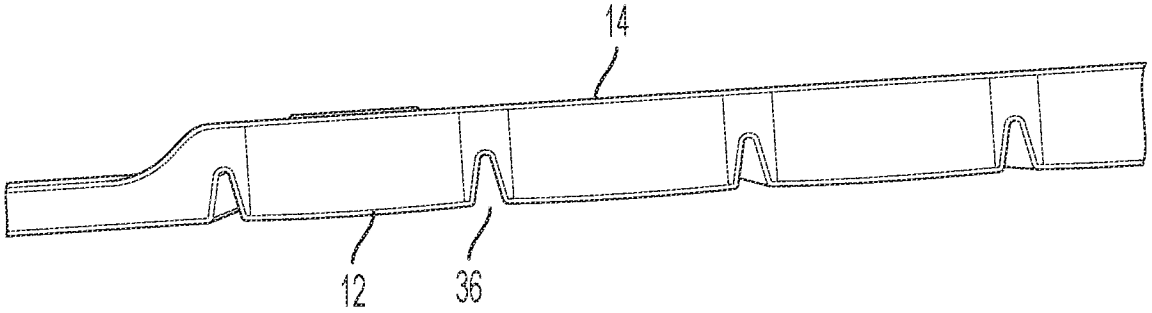
FIG. 4 is a partial side elevation view of the bracelet, in accordance with an embodiment.
Figure 5:
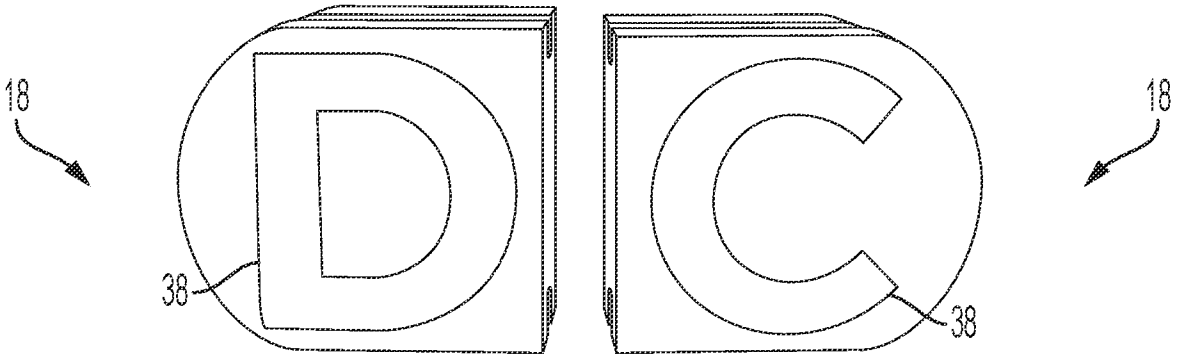
FIGS. 5 and 6 are elevation views of a pair of charms, in accordance with an embodiment.
Figure 6:
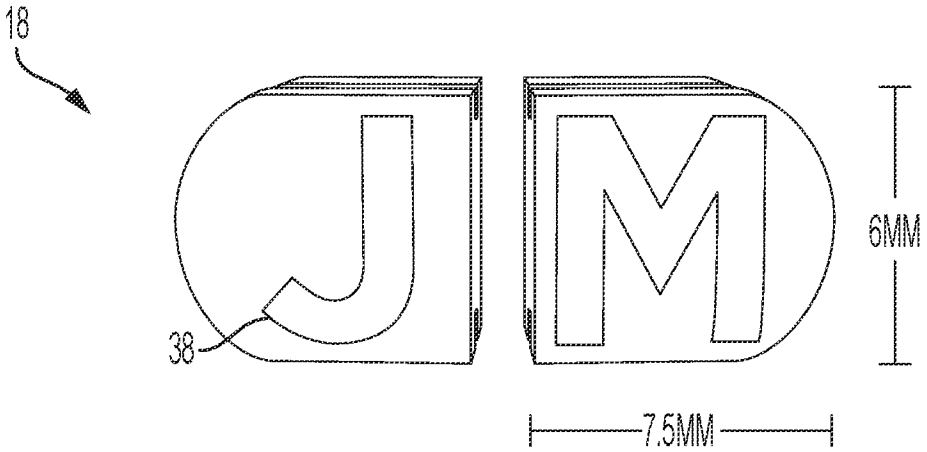
Figure 7:
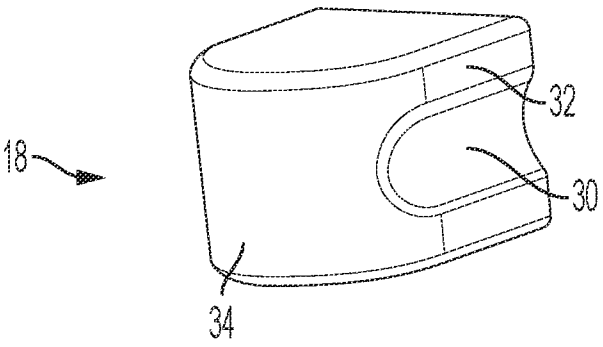
FIG. 7 is a perspective view of a charm, in accordance with an embodiment.
Figure 8:
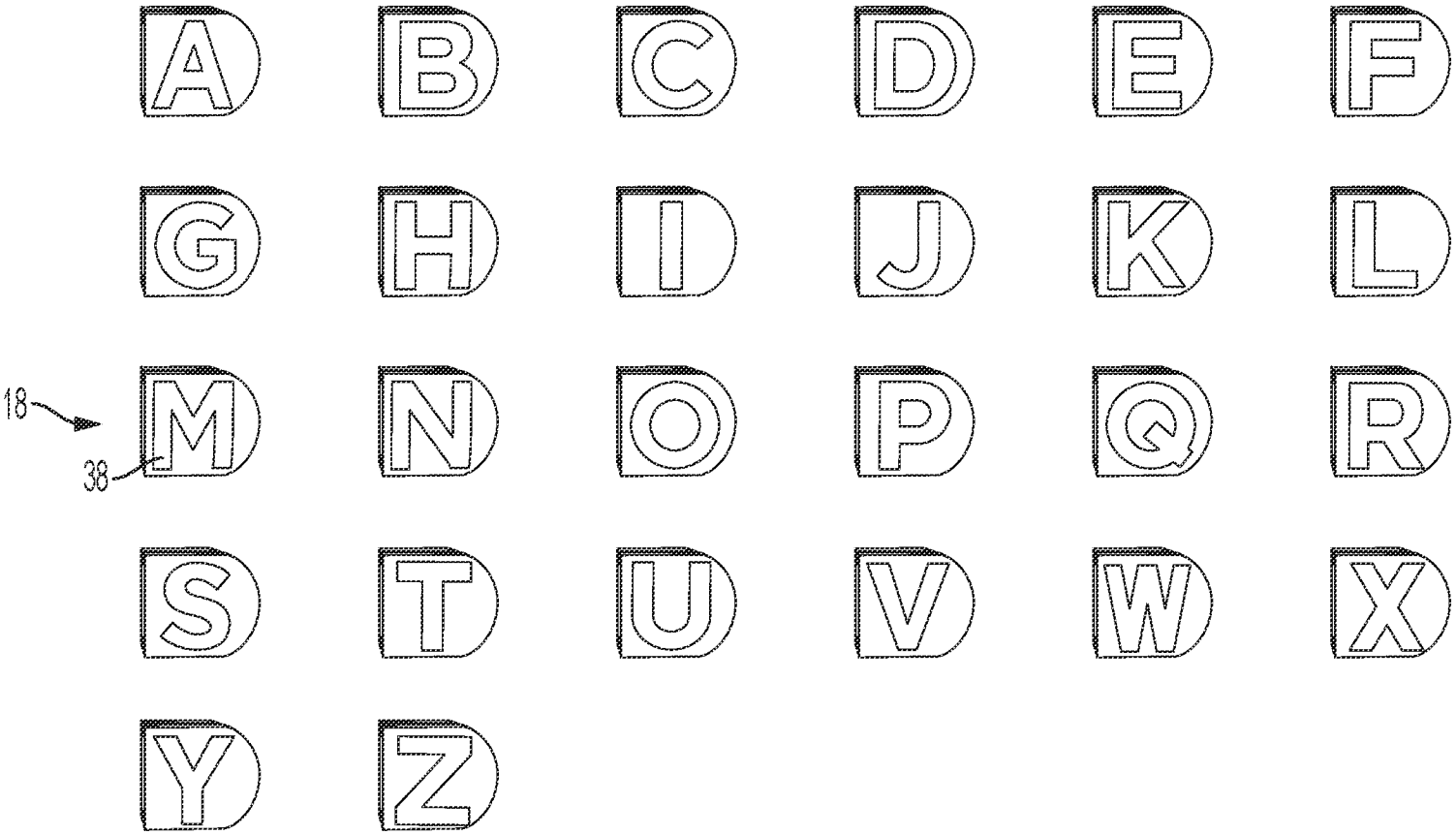
FIG. 8 is an elevation view of a complete set of charms, in accordance with an embodiment

The band 12 is molded in a flat position with V-shaped notches 36 formed on the underside between each successive socket 14, as shown in FIG. 3. By molding the band in this manner, it ensures a completely organic, wrist-molding fit when the band 12 is bent around a user's wrist.

Each charm 18 is screen printed with a letter (or other icon/indicia) 38 to maintain an upper surface that is completely planar. Each shell 16/socket 14 retains a pair of charms 18 that can be formed into desired letter (or icon) combinations (e.g., a friend's or family member's initials)

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A bracelet, comprising:

a. a molded band of predetermined length extending between first and second terminal ends, having upper and lower surfaces, and being composed of a flexible material, the band comprising a plurality of openings formed therethrough and with a V-shaped notch formed in the lower surface between each successive opening;

b. a shell composed of a rigid material lining each of the plurality of openings formed through the band, each shell comprising a pair of opposed long interior surfaces and a pair of opposed short interior surfaces that defined a predetermined width between the opposing interior long surfaces and a predetermined length extending between the predetermined short surfaces, and a protrusion formed on each of the opposed long interior surfaces; and c. a plurality of charms each of which contains indicia imprinted thereon, each charm being of a width that is the same as the predetermined width and a length that is one half the predetermined length, each charm comprising a recess formed in opposing side surfaces thereof that correspond in size and shape the protrusions formed on the interior long surfaces of the shells.

2. The bracelet according to claim 1, wherein the band comprises a plurality of tread-like ridges formed around the periphery of each opening.

3. The bracelet according to claim 2, wherein each shell engages the plurality of tread-like ridges, whereby the interconnection between the shell and band is reinforced.

4. A method of manufacturing a bracelet, comprising the steps of:

a. molding an elongated band that extends a predetermined length between first and second terminal ends with a plurality of openings formed in succession therethrough;

b. forming a V-shaped notch between each successive opening;

c. over molding a rigid shell within each opening, with each shell comprising opposing long interior surfaces and opposing short interior edges; and d. forming a protrusion on each long interior surface.

5. The method according to claim 4, further comprising the step of forming tread-like ridges around the periphery of each opening.

6. The method according to claim 4, comprising the further step of forming a plurality of charms each of which includes a pair of opposing long surfaces and a pair of opposing short edges.

7. The method according to claim 6, comprising the further step of forming a recess in each opposing short edge of each charm that corresponds in size and shape with the protrusions formed on each long interior surface of each shell.

8. The method according to claim 6, comprising the step of screen-printing indicia on the upper surface of each charm to maintain the planarity of the upper surface.

* * * * *